United States Patent [19]

Avery

[11] Patent Number: 4,705,706

[45] Date of Patent: Nov. 10, 1987

[54] TUFTED CARPETING HAVING STITCHES THERMALLY BONDED TO BACKING

[75] Inventor: George S. Avery, Rome, Ga.

[73] Assignee: AVCO Synthetic Turf Production Distribution, Inc., Rome, Ga.

[21] Appl. No.: 907,817

[22] Filed: Sep. 16, 1986

[51] Int. Cl.[4] ..... B32B 33/00

[52] U.S. Cl. ..... 428/17; 156/72; 428/95

[58] Field of Search ..... 428/17, 95; 156/72, 156/435

[56] References Cited

U.S. PATENT DOCUMENTS

| | | | |
|---|---|---|---|
| 3,285,797 | 11/1966 | Harrison et al. | 428/95 |
| 3,616,137 | 10/1971 | Horton | 428/95 |
| 4,426,415 | 1/1984 | Avery | 428/95 |

*Primary Examiner*—Marion C. McCamish

*Attorney, Agent, or Firm*—Cushman, Darby & Cushman

[57] ABSTRACT

The back-loops of the stitches of pile yarn of a tufted carpet are fastened to the backing by thermal bonding, obviating the need for applying an adhesive coating to the underside of the backing. By preference, the thermal bonding is accomplished by using as the pile yarn a yarn made of or incorporating a synthetic thermoplastic material which becomes tacky at a temperature below that at which the backing is adversely affected. For instance, yarn made of or containing polyethylene may be thermally bonded to a backing made of nylon. The backing acts as a sufficient thermal barrier or heat sink as to prevent damage to the face pile during application of heat to the underside of the backing while conducting the thermal bonding step. Where other backings and coatings are omitted, a tufted carpet of superior porosity may be made, e.g. for use as a sand-filled artificial turf.

24 Claims, 2 Drawing Figures

Fig. 1
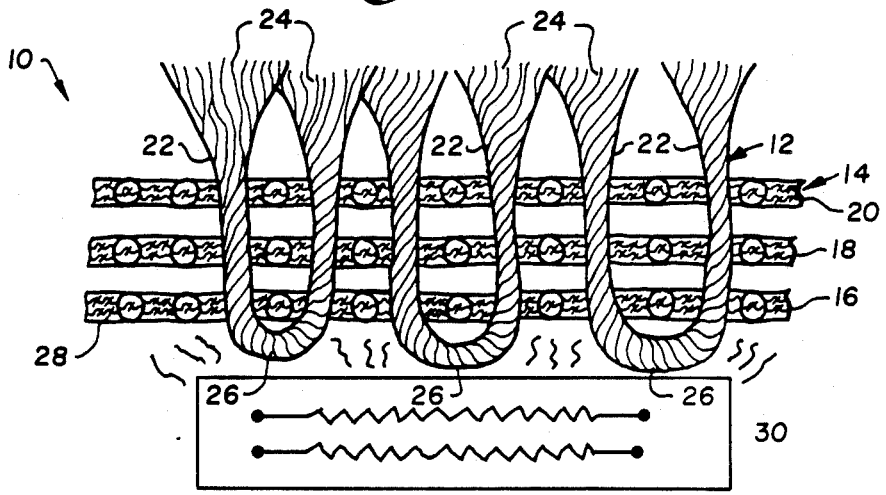
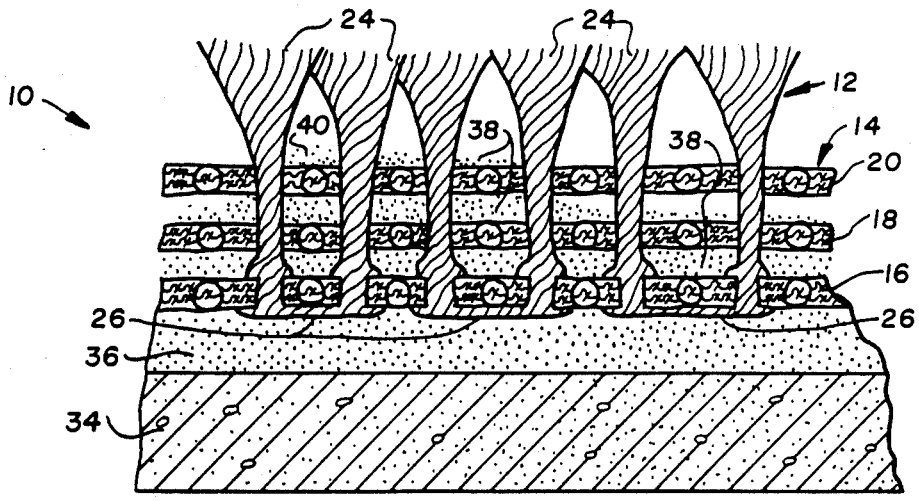
Fig. 2

TUFTED CARPETING HAVING STITCHES THERMALLY BONDED TO BACKING

BACKGROUND OF THE INVENTION

Typically, tufted carpeting is produced by stitching a plurality of rows of yarn loops through a previously-manufactured mesh-like backing so that the yarn protrudes above one face of the backing as a pile, and is drawn relatively closely against the opposite face of the backing. The pile, formed as yarn loops may be permitted to remain as loops, or it may be sheared or otherwise cut to create a cut pile rather than a looped pile. It is necessary to perform a further operation on the as-tufted product in order to lock the pile in place. Otherwise, even slight pulling on any of the loops or tufts of pile yarn will separate the yarn from the backing. In instances in which the pile is cut pile, pulling can separate individual tufts leaving naked spots, and in instances in which the pile is uncut pile, pulling on one loop can create a snag leaving a whole row or a segment of row as a naked strip on the carpet face. By far the heretofore most popular way of locking the tufted yarn to the backing has been to apply an adhesive to the back of the backing, after tufting, in such a manner as to adhere the back loops of the yarn to the backing, mechanically entrap the back loops of the yarn in a common matrix with the backing, and in order to obscure access to the back loops.

As may be imagined, there are many variations in the constituency of tufted carpets, and in the processes and apparatus used for making tufted carpeting. For instance, some tufted carpeting is made by stitching yarn through two or more layers of backing, e.g. having two or more different gauges (number of picks per inch); see the Avery U.S. Pat. No. 4,426,415, issued Jan. 17, 1981. Multiple backings, when used, can strengthen the product, stiffen it, provide additional holding power against pulling-out of stitches, help to hold the face pile upright and help prevent back-coating composition from flowing excessively into the face pile as it is applied to the back.

In some instances the or a layer of the backing is made of flexible plastic film or non-woven fabric, rather than a fabric mesh. In some instances the coating which is applied to the underside of the backing doubles in function as a non-slip surface-providing means; in other instances, the stitch-locking coating is itself backed with one or more layers of woven fabric, plastic film, non-woven fabric and/or a non-slip feature-providing coating. Backings are made from a variety of materials, including, without limitation, natural materials typified by jute, and synthetic polymeric materials typified by polypropylene. Backings are made of varous weights, gauges and weaves.

For some applications, it is desirable that the combination of the backing layer or layers, the back-loops of the tufted yarn, the stitch-locking layer and additional layers provide a substantially continuous barrier separating the face of the carpet from the base on which the carpet is laid. For other applications the exact opposite—porosity through the carpeting from face to underside—is desirable or, indeed, essential.

A particularly popular use of tufted carpeting is as artificial turf, both for playing surfaces for the conduct of sports activities such as football, baseball, soccer and the like, and for landscaping or decorating various indoor and outdoor sites.

A recent practice in the use of artificial turf has involved the spreading of sand, soil, or some other filler material onto the surface of the turf. The purpose of the filler material is to provide a playing surface which is more closely similar to natural (grass/soil) playing surfaces. Artificial turf, as presently produced, does not allow sufficient quantities of filler material to be worked into the turf, does not allow for proper drainage of water from the surface, and erodes (wears out) too quickly when used with most filler materials.

SUMMARY OF THE INVENTION

The back-loops of the stitches of pile yarn of a tufted carpet are fastened to the backing by thermal bonding, obviating the need for applying an adhesive coating to the underside of the backing. By preference, the thermal bonding is accomplished by using as the pile yarn a yarn made of or incorporating a synthetic thermoplastic material which becomes tacky at a temperature below that at which the backing is adversely affected. For instance, yarn made of or containing polyethylene may be thermally bonded to a backing made of nylon. The backing acts as a sufficient thermal barrier or heat sink as to prevent damage to the face pile during application of heat to the underside of the backing while conducting the thermal bonding step. Where other backings and coatings are omitted, a tufted carpet of superior porosity may be made, e.g. for use as a sand-filled artificial turf.

The principles of the invention will be further discussed with reference to the drawing wherein a preferred embodiment is shown. The specifics illustrated in the drawing are intended to exemplify, rather than limit, aspects of the invention as defined in the claims.

DESCRIPTION OF THE DRAWING

In the Drawing

FIG. 1 is a fragmentary longitudinal cross-sectional view of tufted carpet being produced in accordance with principles of the present invention; and FIG. 2 is a similar fragmentary longitudinal cross-sectional view of the tufted carpeting of FIG. 1, in use as a sand-filled artificial turf laid on a base.

DETAILED DESCRIPTION (In this document, terms of orientation such as "face" and "underside" refer to the tufted carpeting in its usual orientation of use, i.e. the orientation depicted in FIG. 1. Of course, while the product is being manufactured, it or its precursor or components may be rightside-up, upside down, vertically oriented or rolled and, unless the contrary is evident from the context, terms of orientation as used herein should not be interpreted as referring to the product, its precurser or components while in such temporary states. For example, when the term "underside" is used, what is meant is the side which is the underside when the carpet is in normal use, regardless of whether that side is on the bottom, on the top or on the side while the product is being manufactured.)

A section of tufted carpeting 10 is shown in FIG. 1 at a stage after the rows of stitches of yarn 12 have been stitched into the backing 14 by utterly conventional carpet tufting machinery. Both the yarn 12 and the backing 14 may be utterly conventional. In this particular drawing figure, because it is a longitudinal sectional view, only one row of stitches is visible. Other rows substantially like the one shown should be understood to be present in planes parallel to but successively further in front of and behind the plane of this drawing figure.

In the instance depicted, the backing 14 is present in a plurality of (e.g. three) layers 16, 18, 20. However, any number of layers from one to several may be used, and if two or more are present they may be alike, or they may differ from one another, e.g. in weight, number of picks per inch, composition, kind and the like. Where three layers of backing are present, the upper layer 16 may be thought of as being the surface backing, the middle layer 18 may be thought of as being the intermediate backing, and the lower layer 20 may be thought of as being the bottom backing.

Also in the instance depicted, the face loops of the pile yarn have been conventionally cut so as to form sheared pile, i.e. of individual tufts 22 characterised by ends 24. In other instances, the pile loops may be left uncut, as is conventionally an alternative to cut pile. However, in either case, the backloops 26 of the pile yarn are, as a result of the conventional tufting yarn stitching and looping process, drawn comparatively tight against the underside 28 of the backing 14.

In a conventional tufted carpet, the back-loops 26 would be fastened to the backing 14 by applying a coating of flexible adhesive material, e.g. foam rubber to the underside 28 of the backing. Although it would not necessarily depart from the principles of the present invention to provide some sort of coating on the underside of the backing after the backing had been tufted, e.g. to provide a non-slip surface, a pesticide or the like, it is believed to be an important departure of the present invention from the prior art to principally lock the pile yarn stitching to the backing by temporarily partially melting the back-loops 26 in order to cause them to become thermally bonded to the backing, e.g. to the bottom backing 20.

Particularly in instances in which the backing is used in multiple layers, the layers above the bottom layer have an important function of preventing the face pile of the carpeting from being damaged by the heat as the back-loops 26 are being thermally bonded to the backing.

In practice, the heating for effecting the thermal bonding may be applied in any of a variety of ways which may be found to be suitable. A way is simply running the underside of the as-tufted backing over a sufficiently-heated platen 30 at a sufficient rate to permit the necessary heat transfer to take place. Jets of heated gas likewise could be directed in a band against the underside of the as-tufted backing. If one of the backing lyers, e.g. the bottom backing were to incorporate an electrically-conductive material, e.g. a ferro-metal foil or fine ferro-metal particles, radio-frequency energy could be applied to the backing from either side in order to temporarily produce sufficient heating of the pile yarn where it penetrates or is disposed adjacent that layer in order to provide the desired thermal bonding.

As shown in FIG. 2, when the resulting tufted carpeting 10 is laid on a base 34, e.g. topped by particulate material 36 such as sand, the carpeting 10 may have its voids (i.e. its interstitial spaces 38) partially filled with a particulate filler 40 such as sand, which, due to the preferable porosity of the carpeting 10 is in communication with the particulate material 36 of the base.

The principles of the present invention are equally applicable to products which may be referred to as either carpet or artificial turf, and to products which incorporate either single or multiple layered backings, which may be either of woven construction or of solid, film-type construction.

The invention applies to carpeting which is produced by stitching (tufting) loops through a backing material. The method of locking the stitches to the backing by thermal bonding, and the mechanism which allows for the locking of the stitches to the backing, are unique and significant features of this invention.

By preference, dissimilar materials are used for the stitches and the backing, i.e. so that the back-loops of the tufted yarn can be thermally bonded to the backing at a lower temperature than one which would degrade the backing. Further, the backing mterial is selected such that it will readily accept the fusing of the stitches onto it.

Another feature of the preferred embodiment of the present invention is the use of multiple layers of backings, for the dual purpose of structural integrity of the final product and thermal absorption of heat energy during the production process. The use of the multiple layers, as set forth, involves materials which will form a thermal barrier between the heat (supplied to the backing to fuse the stitches to the backing) source and the face pile. The absorption of heat in the multiple layers of backing keeps the temperature on the face pile below that which would result in degradation of the face pile.

As a practical example, the carpet of the present invention may incorporate a polyethylene material for the tufted stitches and a nylon backing material. These materials may be of various weights and weaves, depending upon the product application. The fusion point of the polyethylene is approximately 300° F. whereas the fusion point of the nylon is approximately 600° F. Upon application of heat to the back side of the product, the polyethylene stitches fuse to the nylon backing forming a permanent bond of the stitches to the backing. The intermediate and upper layers of nylon backing, when used, form a heat sink: or thermal barrier because of the thermal properties of the backing material preventing unwanted heat transfer to the face pile. This process may be accomplished without the use of any separate (e.g. adhesive) bonding agent.

When the principles of the present invention are practiced according to the preferred embodiment for producing a porous, particle-filled artificial turf such as is depicted in FIG. 2, the following features and functions may be obtained:

(a) More upright stitches (tufts) in the final product, as opposed to stitches which have considerable lean (deviation from the vertical);
(b) More receptivity to a filler material (soil, sand, etc.) because of the stitches being upright;
(c) More uniform distribution of the filler material onto and into the artifical turf;
(d) More and heavier stitches (and therefore more wearability) per unit surface area of product;
(e) More uniform drainage capability of the product due to uniformly distributed porosity of product and numerous non-blocked drainage outlets through the backing;
(f) Elimination of surface contamination of the product due to there being no bonding agent leaking through to the face of the turf;
(g) Reduction of the cost of materials for the product due to the elimination of a separate bonding agent.

Of course, in other practices of the invention, one or more of the above characteristics may be foregone, without departing in the main from the fundamental principles of the present invention.

It should now be apparent that the tufted carpeting having stitches thermally bonded to backing as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A process for preparing tufted carpeting, comprising:

(a) providing a backing having a front side and an underside, said backing comprising at least one layer;

(b) stitching a plurality of side-by-side rows of yarn through said backing so as to dispose back-loops of said yarn closely adjacent said underside of said backing and so as to dispose pile on the front side of said backing, which pile projects outwards from said front side of said backing; and (c) applying energy to the thus-tufted backing, sufficient to thermally bond said back-loops of said yarn to said backing as at least the principal mode for bonding said yarn to said backing, said backing remaining substantially porous to sand upon completion of step (c).

2. The process of claim 1, wherein:

said backing comprises a plurality of layers.

3. The process of claim 1, wherein:

said yarn is made, at least in part, of a synthetic thermoplastic material which becomes tacky at an elevated temperature which is below that at which said backing becomes tacky or is otherwise substantially thermally degraded.

4. The process of claim 3, wherein:

said synthetic thermoplastic material is polyethylene.

5. The process of claim 4, wherein:

said backing is made of woven nylon net.

6. The process of claim 1, wherein:

step (c) is conducted by passing the tufted backing over a heat source.

7. The process of claim 6, wherein:

the heat source is a heated platen.

8. A process for providing a sand-filled artificial turf, comprising:

(a) providing a backing having a front side and an underside, said backing comprising at least one layer;

(b) stitching a plurality of side-by-side rows of yarn through said backing so as to dispose back-loops of said yarn closely adjacent said underside of said backing and so as to dispose pile on the front side of said backing, which pile projects outwards from said front side of said backing;

(c) applying energy to the thus-tufted backing, sufficient to thermally bond said back-loops of said yarn to said backing as at least the principal mode for bonding said yarn to said backing, said backing remaining substantially porous to sand upon completion of step (c);

(d) laying the product resulting from conducting step (c) on a sand-covered foundation; and (e) at least filling the pile on the front side of the backing of the product resulting from conducting step (d), with sand and working some of that sand into physical contact through said backing with sand of said covered foundation.

9. The process of claim 8, wherein:

said backing comprises a plurality of layers.

10. The process of claim 8, wherein:

said yarn is made, at least in part, of a synthetic thermoplastic material which becomes tacky at an elevated temperature which is below that at which said backing becomes tacky or is otherwise substantially thermally degraded.

11. The process of claim 10, wherein:

said synthetic thermoplastic material is polyethylene.

12. The process of claim 11, wherein:

said backing is made of woven nylon net.

13. The process of claim 8, wherein:

step (c) is conducted by passing the tufted backing over a heat source.

14. The process of claim 13, wherein:

the heat source is a heated platen.

15. A tufted carpet, comprising:

a backing having a front side and an underside, said backing comprising at least one layer;

a plurality of side-by-side rows of yarn stitched through said backing, these rows comprising:

back-loops of said yarn disposed closely adjacent said underside of said backing, and pile of said yarn disposed on the front side of said backing, which pile projects outwards from said front side of said backing;

said back-loops of said yarn being thermally-bonded to said backing as at least the principal mode for bonding said yarn to said backing, said backing while having said back-loops of said yarn thermally bonded thereto, remaining substantially porous to sand.

16. The tufted carpet of claim 15, wherein:

said backing comprises a plurality of layers.

17. The tufted carpet of claim 15, wherein:

said pile is a sheared pile.

18. The tufted carpet of claim 17, wherein:

said pile is made of synthetic thermoplastic material simulating turf.

19. The tufted carpet of claim 18, wherein:

said synthetic thermoplastic material is one which becomes tacky at an elevated temperature which is below that at which said backing becomes tacky or is otherwise substantially thermally degraded.

20. A sand-filled artificial turf, comprising:

a backing having a front side and an underside, said backing comprising at least one layer;

a plurality of side-by-side rows of yarn stitched through said backing, these rows comprising:

back-loops of said yarn disposed closely adjacent said underside of said backing, and pile of said yarn disposed on the front side of said backing, which pile projects outwards from said front side of said backing;

said back-loops of said yarn being thermally-bonded to said backing as at least the principal mode for bonding said yarn to said backing, said backing while having said back-loops of said yarn thermally bonded thereto, remaining substantially porous to sand;

said tufted backing being disposed on said sand-covered foundation and having the pile thereof at least partially filled with sand, which is in physical contact with sand of said sand-covered foundation through said backing.

21. The tufted carpet of claim 20, wherein:

said backing comprises a plurality of layers.

22. The tufted carpet of claim 20, wherein:

said pile is a sheared pile.

23. The tufted carpet of claim 22, wherein:

said pile is made of synthetic thermoplastic material simulating turf.

24. The tufted carpet of claim 23, wherein:

said synthetic thermoplastic material is one which becomes tacky at an elevated temperature which is below that at which said backing becomes tacky or is otherwise substantially thermally degraded.

* * * * *